US005206453A

United States Patent [19]

Rieger

[11] Patent Number: 5,206,453

[45] Date of Patent: Apr. 27, 1993

[54] EJECTION MODULE FOR SUBAMMUNITION CONTAINER

[75] Inventor: Ulrich Rieger, Feldkirchen/Westerham, Fed. Rep. of Germany

[73] Assignee: Messerschmitt-Bolkow-Blohm GmbH, Fed. Rep. of Germany

[21] Appl. No.: 766,192

[22] Filed: Sep. 27, 1991

[30] Foreign Application Priority Data

Oct. 20, 1990 [DE] Fed. Rep. of Germany ..... 4033476

[51] Int. Cl.[5] ..... F42B 12/58; B64D 1/04

[52] U.S. Cl. ..... 89/1.51; 89/1.57

[58] Field of Search ..... 89/1.51, 1.56, 1.57, 89/1.11; 102/393, 489

[56] References Cited

U.S. PATENT DOCUMENTS

| | | | |
|---|---|---|---|
| 2,979,991 | 4/1961 | Buschers et al. | 89/1.51 |
| 4,172,407 | 10/1979 | Wentink | 89/1.56 |
| 4,307,650 | 12/1981 | Kuesters et al. | 89/1.56 |
| 4,750,403 | 6/1988 | Huber et al. | 89/1.51 |
| 4,941,392 | 7/1990 | Huetter | 89/1.51 |
| 5,005,481 | 4/1991 | Schneider et al. | 102/393 |
| 5,014,590 | 5/1991 | Moggert | 89/1.57 |

FOREIGN PATENT DOCUMENTS

| | | | |
|---|---|---|---|
| 2204388 | 11/1988 | United Kingdom | 89/1.51 |

*Primary Examiner*—David H. Brown

*Attorney, Agent, or Firm*—Evenson, McKeown, Edwards & Lenahan

[57] ABSTRACT

An injection module for a subammunition container, of the type in which subammunitions, ejected transversely to the flight direction of the subammunition container, are situated in front of driving devices which are actuated by gas-generator-driven ejecting pistons. The ejecting pistons are arranged transversely with respect to the flight direction, and may extend along half the width or the full width of the ejecting module. The gas generator may be arranged transversely or longitudinally of the flight direction.

13 Claims, 6 Drawing Sheets

FIG. 1
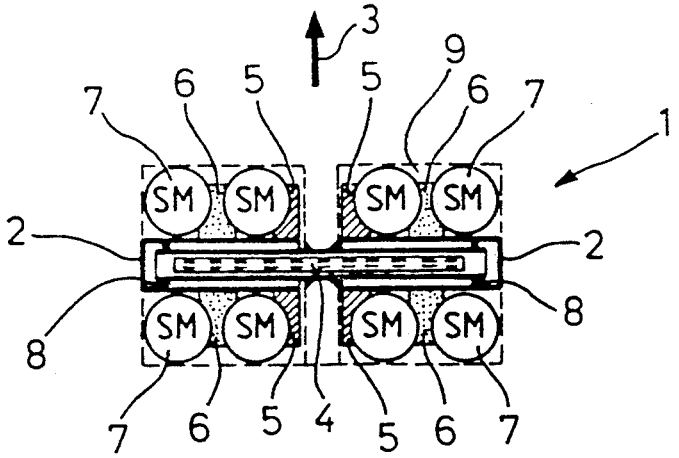
FIG. 2
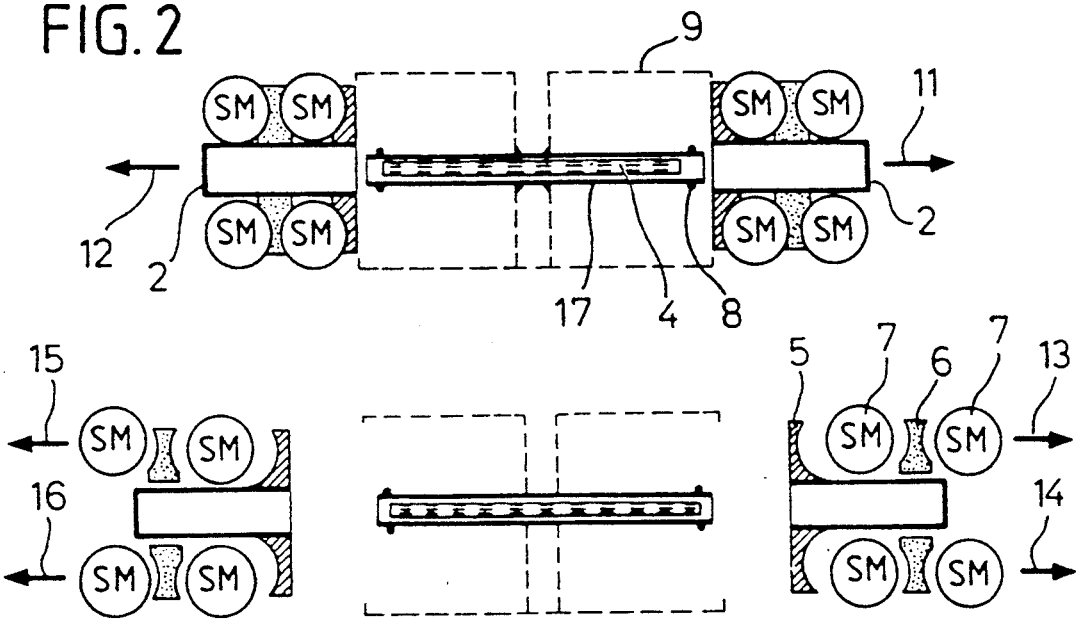
FIG. 3
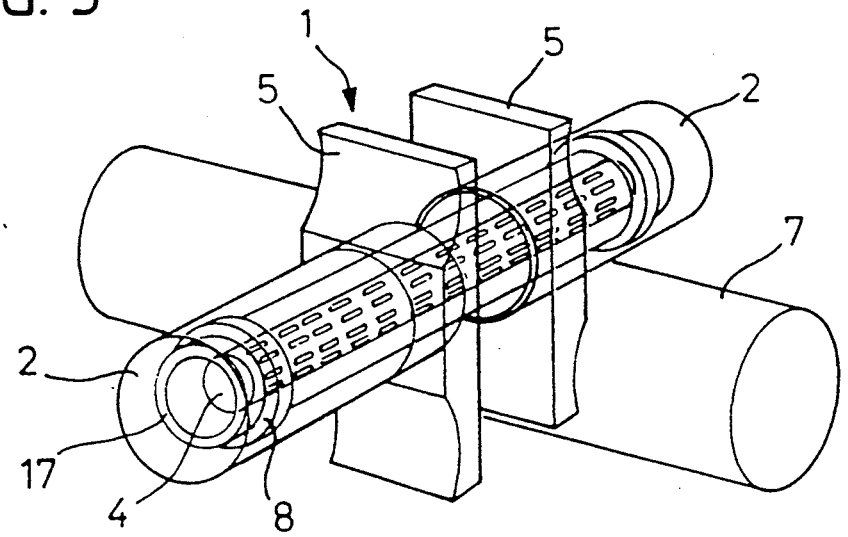
FIG. 4

EJECTION MODULE FOR SUBAMMUNITION CONTAINER

BACKGROUND AND SUMMARY OF THE INVENTION

The present invention relates to an ejection module for a subammunition container.

European Patent Document EP 0 169 956 A1 discloses an ejection module of this generic type in which a bomb or a missile with a warhead has two sets of nine subammunitions arranged respectively in two circular patterns disposed one behind the other. Each subammunition has an ejecting piston which is arranged in a cylinder and which can be acted upon by a propellant by means of a pyrotechnic primer inserted on the floor of the cylinder. When the primers are ignited, the subammunitions are driven radially toward the outside by the ejecting pistons. This device can therefore only be used as a bomb in vertical or parabolic flight, the subammunitions covering an approximately circular target area.

German Patent Document DE-PS 30 48 469 discloses another ejection module in which the subammunition container has several ejection modules with ejection tubes arranged transversely with respect to the direction of flight. The munitions canisters are inserted into ejection tubes taking up the whole width of the munitions container and are driven out by a central gas generator like pistons. This arrangement is therefore suitable only for subammunitions adapted to the size of the ejection tubes.

It is an object of the present invention to provide an ejection module of the initially mentioned type by means of which large bulky subammunition can also be ejected in horizontal flight at a high ejecting speed, with moderate acceleration.

This object is achieved by the ejection module according to the invention in which subammunitions are situated in front of driving elements actuated by gas generator driven pistons and are ejected transversely to the direction of flight of the munitions container. The gas generator may be arranged transversely or longitudinally of the flight direction.

The principal advantage of the invention is that due to the arrangement of the driving devices, bulky subammunition can also be ejected in an essentially horizontal direction, and are brought to a high ejecting speed with moderate acceleration. By means of the ejection module according to the invention, it is possible to carry out an almost recoil-free ejection of at least two subammunitions disposed opposite one another. Moreover, with several ejection modules arranged behind one another and successive ejection of the subammunitions of the individual ejection modules, a larger target surface can be covered with subammunitions, and the sequence of ejections can be distributed over a longer period of time in horizontal flight. In this case, the ejection is caused in a known manner by gas pressure from only one gas generator.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial sectional view of a first embodiment of an ejection module with a traverse gas generator and a short ejecting piston;

FIGS. 2 and 3 are views of the ejection module according to FIG. 1 in two different phases of ejection;

FIG. 4 is a phantom view of the ejection module according to FIG. 1 with only one subammunition;

DETAILED DESCRIPTION OF THE DRAWINGS

Figure 5:
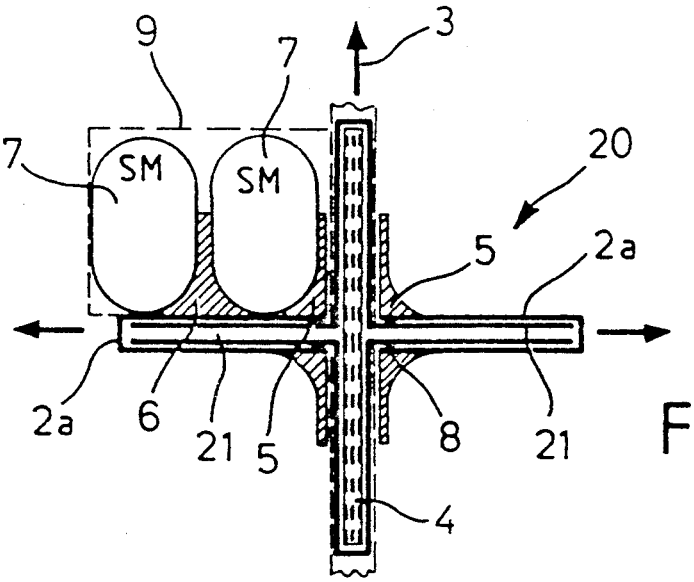
FIG. 5 is a top view of a second embodiment of an ejection module with a lengthwise gas generator and a short ejecting piston.

FIGS. 1 to 4 show an ejection module 1 with two mirror-symmetric ejecting pistons 2, which extend approximately half the width of the module, and a gas generator 4 installed inside them. The ejecting pistons 2 and the gas generator 4 are disposed transversely with respect to the flight direction of the ejection module indicated by an arrow 3. Driving devices 5 for subammunitions (SM's) 7 are connected with the ejecting piston 2. Loosely arranged intermediate layers 6 exist between the SM's 7. The gas generator 4 is disposed in a pipe 17 (FIG. 2) which is inserted into the ejecting pistons 2 and serves as a guide for these ejecting pistons 2 during the ejecting operation. If necessary, two sealing and sliding elements 8 are arranged between the pipe 17 and the ejecting piston. As shown in FIG. 2, the ejection module 1 is disposed in a munitions container 9 indicated by an interrupted line. In a known manner, the latter is mounted together with a number of ejection modules 1 on an aircraft or missile. As illustrated in FIG. 2, the ejecting pistons 2 are driven out of the munitions container 9 directly by the gases of the ignited gas generator 4 in the direction of the arrows 11 and 12. When the ejecting pistons 2 are driven out further, corresponding to FIG. 3, the SM's 7 detach from the driving devices 5 and the intermediate layers 6 and fly away in the direction of the arrows 13 to 16.

The phantom view of FIG. 4 clearly shows the simple construction of this ejection module 1. For a better representation, only one SM 7 is illustrated.

FIG. 5 is a top view of an ejection module 20 with a gas generator 4 arranged in the flight direction. In this embodiment, the fuel gases of gas generator 4 flow into a gas pipe 21 which is inserted into each of the respective ejecting pistons 2*a* and serves as a guide for these ejecting pistons 2*a* during the ejection operation. Driving devices 5, in turn, are connected to the ejecting pistons 2*a*. Again for the sake of illustration, only two of the SM's 7 are shown, separated by an intermediate layer 6. The carrier structure 9 of the munitions container is indicated by an interrupted line.

Figure 6:
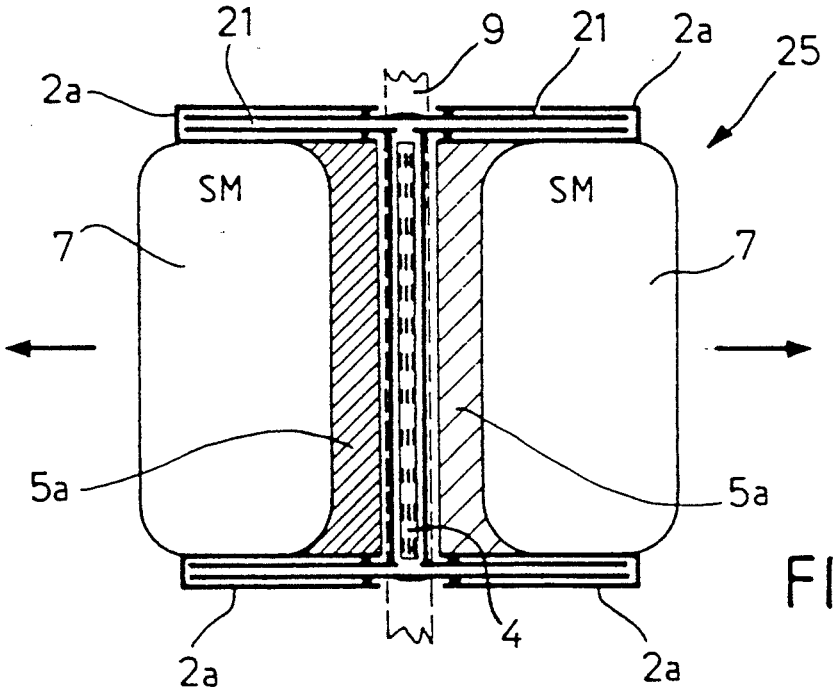
FIG. 6 is a top view of a third embodiment of an ejection module with a lengthwise gas generator and a double ejecting piston.

FIG. 6 illustrates an ejection module 25, in which, for example, for large SM's 7, two ejecting pistons 2*a* respectively are provided which are each connected by way of driving devices 5*a*. Here also, the propellant flows from the gas generator 4 into gas pipes 21. In both embodiments according to FIGS. 5 and 6, the ejecting pistons 2*a* may have a smaller cross-section than those in FIG. 1, so that the overall measurements of the munitions container 9 may be kept small.

Figure 7:
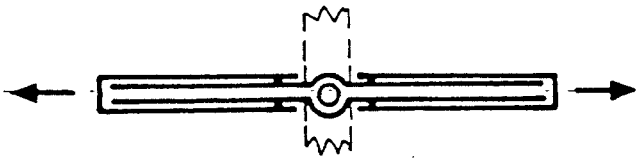
FIG. 7 is a lateral view of FIGS. 5 or 6 with a straight ejecting piston without a subammunition.
Figure 8:
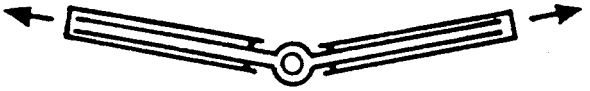
FIG. 8 is a lateral view of FIGS. 5 or 6 with the ejecting piston in a slight V-position without a subammunition.

FIGS. 7 and 8 are views of the ejection modules 20 and 25 in the flight direction, the ejection module in FIG. 8 having a slight V-position so that the SM's (not shown)are provided with a vertical speed component during ejection. With embodiment of FIG. 8, the projection path is increased relative to the ejection height which leads, for example, to wider projecting widths of the SM's. The recoil forces which affect the supporting structure are small in the case of small V-positions.

Figure 9:
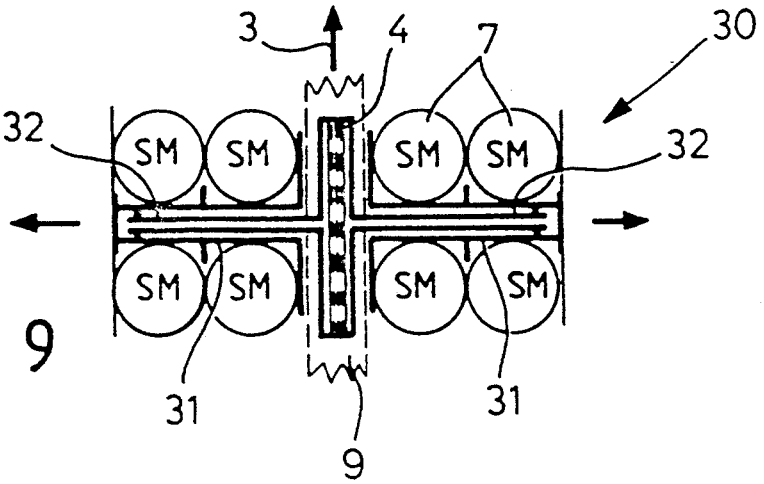
FIG. 9 is a top view of a fourth embodiment of an ejection module with a lengthwise gas generator in a particularly flat construction.
Figure 10:
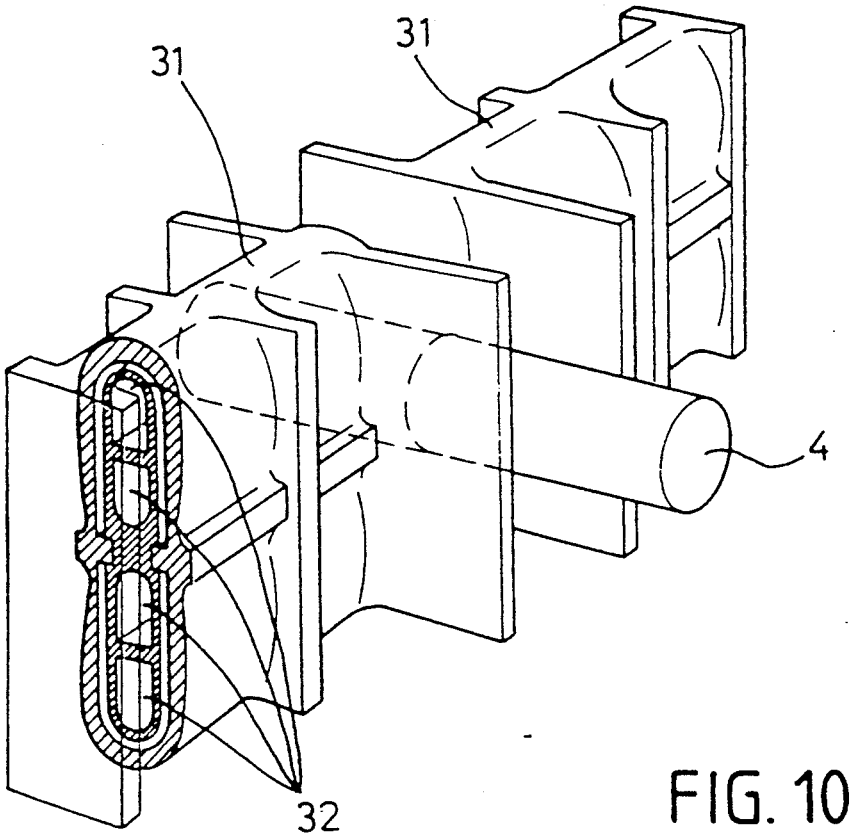
FIG. 10 is a phantom view of the ejection module according to FIG. 9 without a subammunition.

The ejection model 30 illustrated in FIGS. 9 and 10 has a very flatly constructed solution in which the ejecting pistons and the gas pipes 32 do not have a rotationally symmetrical cross-section, as shown particularly in the phantom view of FIG. 10. In this embodiment, the ejecting pistons form a structural unit 31 with the driving devices, whereby the driving forces contribute to the stiffening. In the phantom view, the one end of the structural unit 31 is shown in a sectional view, so that one of the gas pipes 32 segmented into several parallel-acting parts is easily visible.

While the ejecting pistons of the previously described embodiments have a length which is less than half the width of the container modules, in the case of the following embodiments, the ejecting pistons extend along the full width of the ejection modules. This arrangement has the advantage of the largest possible accelerating paths; thus, in the case of a slight acceleration, the highest ejecting speeds for the SM's can be achieved.

Figure 11:
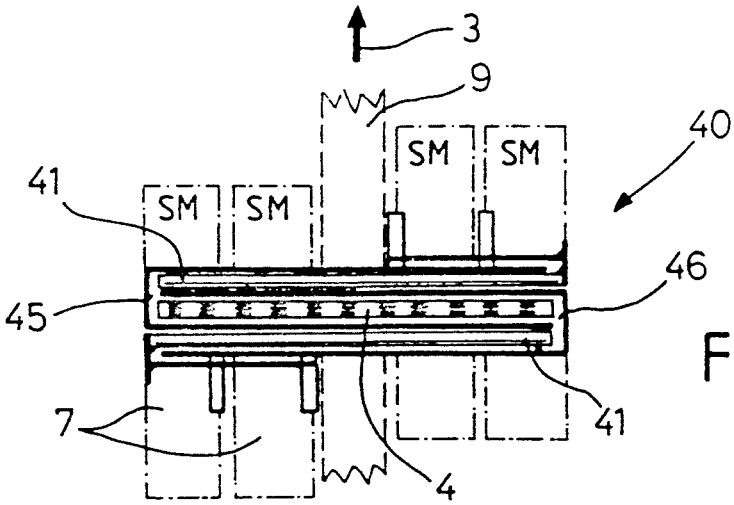
FIG. 11 is a top view of a fifth embodiment of an ejection module with an ejecting piston which extends along the whole width of the module and with the gas generator.
Figure 12:
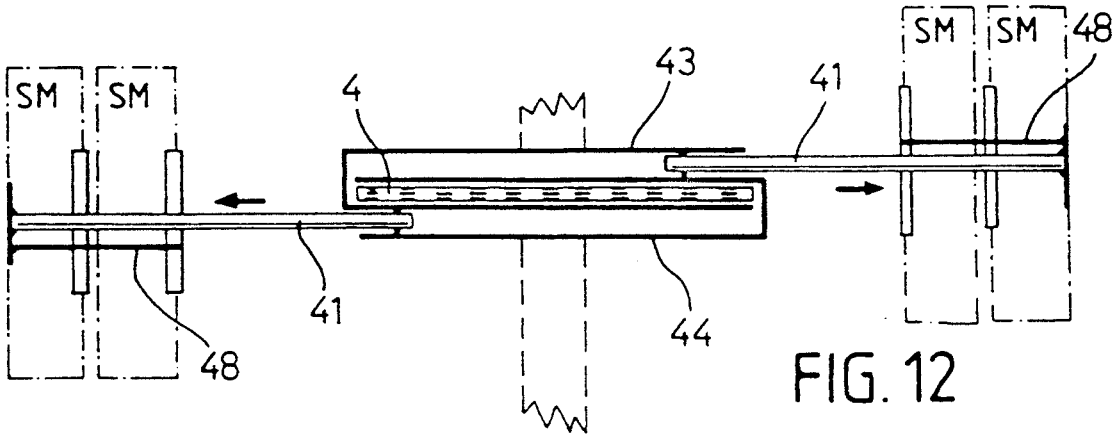
FIG. 12 is a view of the ejection module according to FIG. 11 during ejection of the subammunition.
Figure 13:
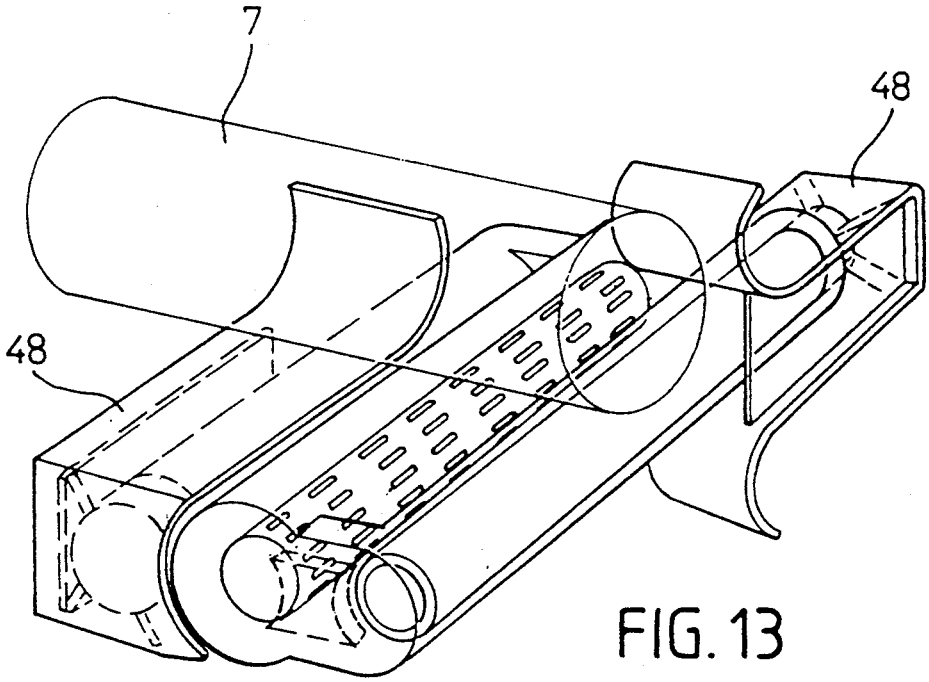
FIG. 13 is a phantom view of the ejection module according to FIG. 11 with only one subammunition.

FIGS. 11 to 13 show an ejection module 40 in which the gas generator 4 is arranged in parallel to the axes between two ejecting pistons 41 which slide in cylinders 43 and 44. On both ends of the gas generator 4, overflow slots 45 and 46 are arranged through which the gas can act upon the ejecting pistons 41.

FIGS. 11 and 12 illustrate the SM's 7 and the supporting structure 9 of the munitions container. The phantom view of FIG. 13 shows that the driving structures 48 are fastened on both sides in the front to the ejecting pistons 41.

Figure 14:
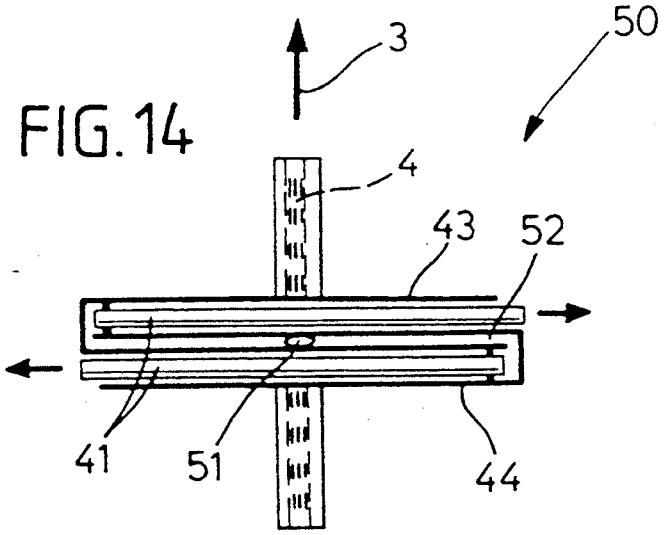
FIGS. 14 to 16 are three views of a sixth embodiment of an ejection module with a long ejecting piston and a lengthwise gas generator.
Figure 15:
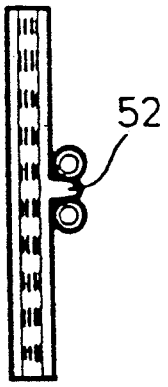
Figure 16:
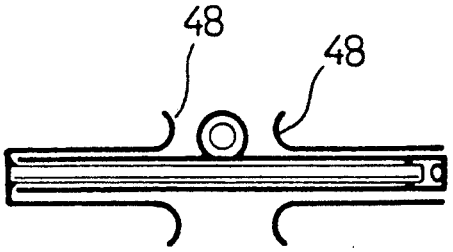

FIGS. 14 to 16 are three views of an ejection module 50 in which the gas generator 4 can be housed in the longitudinal structure of the munitions container which is not shown here. Gas from the gas generator 4 flows behind the ejecting pistons 41 by way of a central overflow slot 51 and gas duct 52. The cylinders 43 and 44 as well as the driving structures 48 correspond to those of FIGS. 11 to 13. The advantage of this arrangement is the slight lateral separation of the ejecting pistons 41 and the resulting low recoil moments.

Figure 17:
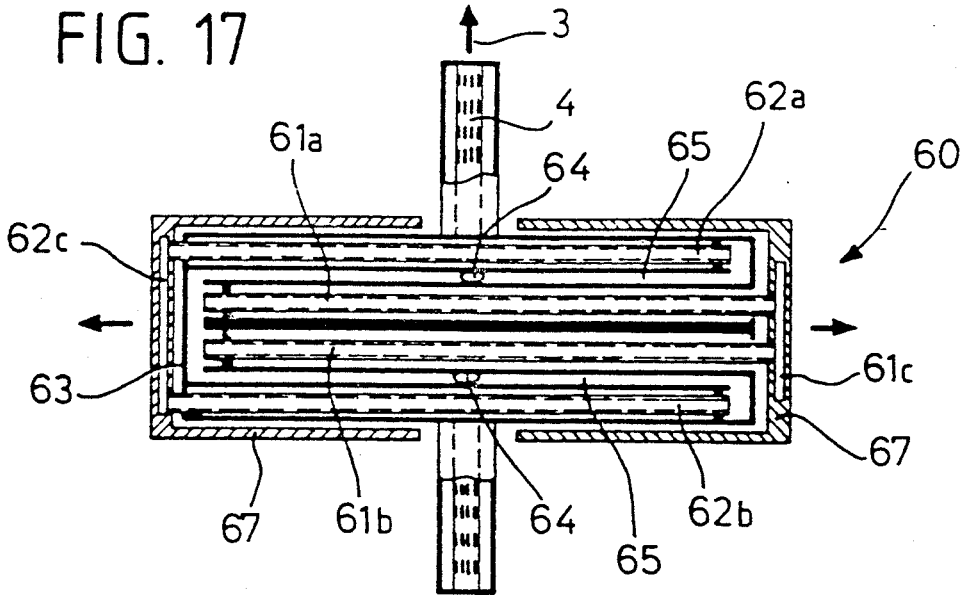
FIGS. 17 and 18 are respectively a top view and a longitudinal view of a seventh embodiment of an ejection module in a flat construction that is free of recoil moments and has four long ejecting pistons and a lengthwise gas generator.
Figure 18:
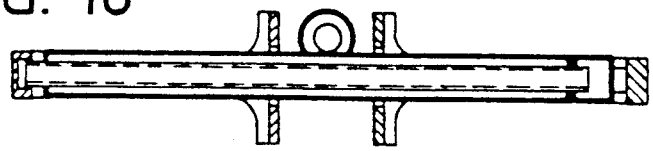
Figure 19:
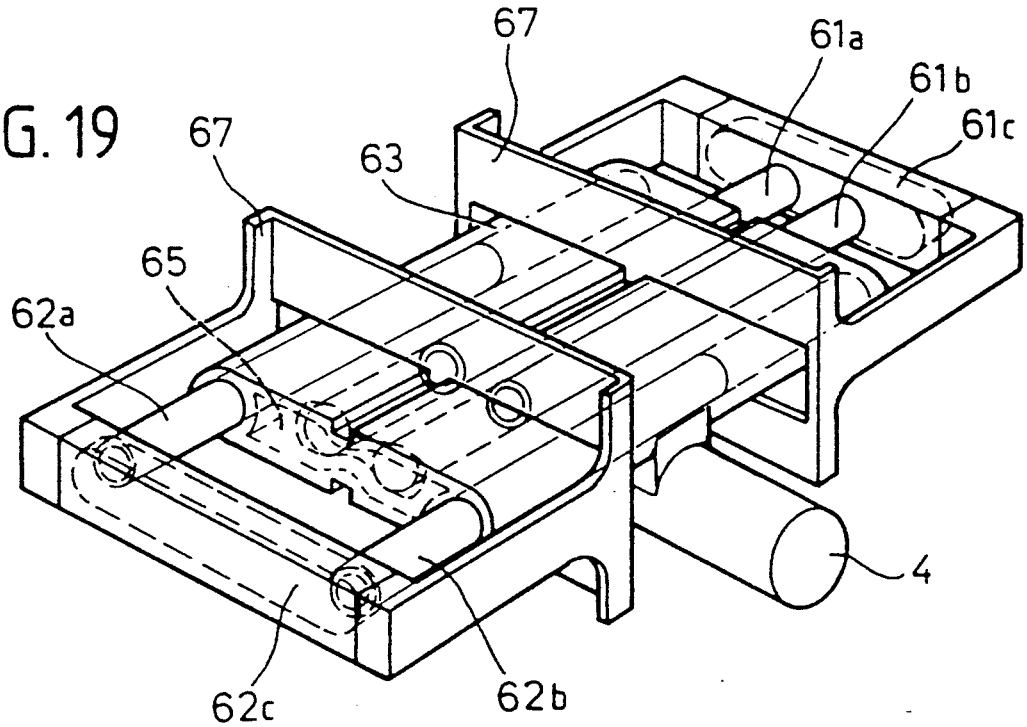
FIG. 19 is a phantom view of the ejection module according to FIGS. 17 and 18.

FIGS. 17 to 19 show a flatly constructed recoil-moment-free arrangement of an ejection module 60. Double ejecting pistons 61 and 62 in a cylinder unit 63, overflow slots 64 and gas ducts 65 are constructed mirror-symmetrically about the axis of the ejection module 60. Each of the ejecting pistons 61 and 62 comprises two longitudinal pipes 61*a*, 61*b* and 62*a*, 62*b* which are connected with one another in piston heads 61*c* and 62*c*. The gas guides in the piston heads 61*c* and 62*c* as well as the gas ducts 65 are constructed to be pressure-compensating so that the same pressure exists in each of the four piston pipes. The gas generator 4 is arranged centrally in the flight direction. Driving structures 67 are fastened to the piston heads 61*c* and 62*c*. In the phantom view of FIG. 19, the ejecting pistons are shown partially slid out for the purpose of a better representation.

Further embodiments of ejection modules for recoil-moment-free ejections are not shown, including, for example, an arrangement of the ejecting pistons in the corners of a square, with diagonally opposite ejecting pistons acting in the same direction;

instead of the two interior ejecting pistons 61 and 61*b*, only one ejecting piston with a double front face size is provided in the ejecting axis, in which case the opposite ejecting pistons 62*a* and 62*b* would continue to exist.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Ejection module arrangement for a subammunitions container of the type wherein subammunitions are ejected from said subammunitions container by gas-driven ejecting pistons, transversely with respect to a flat direction of the munitions container, said ejection arrangement comprising:

a gas generator;

at least one pair of interacting ejection pistons which are acted upon by said gas generator; and driving devices for ejecting said subammunitions, said driving devices being mounted on an peripheral exterior surface of the ejecting pistons, each of said driving devices being arranged to receive and support at least one subammunition;

said ejecting pistons being arranged such that the subammunitions are ejected by said driving devices in an essentially horizontal direction.

2. Ejection module according to claim 1, wherein a cylinder unit, four ejecting pistons which take up approximately a whole width of the ejection module, are arranged mirror-symmetrically with respect to one another in a recoil-moment-free configuration, the gas generator being fastened laterally to the cylinder unit in the flight direction.

3. An ejection module arrangement according to claim 1, wherein four ejecting pistons are each mounted laterally of the gas generator.

4. Ejection module arrangement according to claim 3, wherein the ejecting pistons are arranged in a V-position relative to one another.

5. Ejection module according to claim 1, wherein two ejecting pistons are arranged in cylinders which take up approximately a whole width of the ejection module, and the driving devices are fastened to a front face of the ejecting pistons.

6. Ejection module arrangement according to claim 5, wherein the gas generator is arranged in the flight direction laterally of the cylinders.

7. Ejection module arrangement according to claim 1, wherein mutually opposite ejecting pistons each take up approximately one half the width of the ejection module.

8. Ejection module arrangement according to claim 7, wherein the gas generator is mounted inside the ejecting pistons, which are open in a direction toward the center.

9. Ejection module according to claim 7, wherein the ejecting pistons as well as gas pipes projecting into them have an approximately rectangular cross-section.

10. Ejection module arrangement according to claim 9, wherein the gas generator is arranged transversely to a flight direction in parallel to the cylinders.

11. Ejection module arrangement according to claim 7, wherein the gas generator 4 is mounted in a flight direction between the ejecting pistons, and gas pipes project into the ejecting pistons.

12. Ejection module arrangement according to claim 11, wherein two ejecting pistons are mounted laterally of the gas generator.

13. Ejection module arrangement according to claim 12, wherein the ejecting pistons are arranged in a V-position relative to one another.

* * * * *